United States Patent [19]

Romann

[11] 4,216,757

[45] Aug. 12, 1980

[54] ELECTRICAL CONTROL CIRCUIT, ESPECIALLY FOR A FUEL SUPPLY DEVICE OF AN INTERNAL COMBUSTION ENGINE

[75] Inventor: Peter Romann, Stuttgart, Fed. Rep. of Germany

[73] Assignee: Robert Bosch GmbH, Stuttgart, Fed. Rep. of Germany

[21] Appl. No.: 887,143

[22] Filed: Mar. 16, 1978

[30] Foreign Application Priority Data

Apr. 7, 1977 [DE] Fed. Rep. of Germany ..... 2715588

[51] Int. Cl.[2] ..... F02M 51/00

[52] U.S. Cl. ..... 123/179 L; 123/179 G

[58] Field of Search ..... 123/139 ST, 179 L, 32 EG, 123/179 G

[56] References Cited

U.S. PATENT DOCUMENTS

| | | | |
|---|---|---|---|
| 3,020,905 | 2/1962 | Göschel et al. | 123/179 L |
| 3,646,918 | 3/1972 | Nagy et al. | 123/32 EG |
| 3,704,702 | 12/1972 | Aono | 123/32 EG |
| 3,716,034 | 2/1973 | Schmid | 123/179 L |
| 3,760,495 | 9/1973 | Meyer | 338/22 R |
| 3,847,130 | 11/1974 | Miyoshi et al. | 123/179 L |
| 4,096,833 | 6/1978 | Sweet | 123/32 EG |
| 4,099,508 | 7/1978 | Noguchi et al. | 123/148 DC |

FOREIGN PATENT DOCUMENTS

| | | | |
|---|---|---|---|
| 2530955 | 1/1977 | Fed. Rep. of Germany | 123/32 EG |

*Primary Examiner*—Charles J. Myhre
*Assistant Examiner*—Andrew M. Dolinar
*Attorney, Agent, or Firm*—Edwin E. Greigg

[57] ABSTRACT

An electrical control circuit, especially for a fuel supply device of an internal combustion engine, which serves to control a control member that reacts to the electrical current, said control taking place in dependence on the temperature. The electrical control circuit includes a temperature-dependent element in the form of a cold conducting (PTC resistor), and in the special exemplary embodiment is in the form of an electromagnetic valve as a control member especially to supply additional fuel into the intake manifold of an internal combustion engine at temperatures below a predetermined starting temperature of the internal combustion engine. A relay can also serve as the control member that controls the electrical current of the above-mentioned electromagnetic valve.

4 Claims, 3 Drawing Figures

ELECTRICAL CONTROL CIRCUIT, ESPECIALLY FOR A FUEL SUPPLY DEVICE OF AN INTERNAL COMBUSTION ENGINE

BACKGROUND OF THE INVENTION

The invention relates to an electrical control circuit, and more particularly for a fuel supply device of an internal combustion engine with a control member that reacts to the electric current and with an element that is dependent on temperature. A fuel supply device of an internal combustion engine having a starting device that includes an electrical control circuit is already known, which basically comprises an electromagnetic valve and a thermo-time switch, which limits the opening period of the electromagnetic valve during the starting process of the internal combustion engine, i.e., it completely eliminates the opening period of the electromagnetic valve at starting temperatures above a certain predetermined temperature. The thermo-time switch thus closes or opens the current circuit of the electromagnetic valve in dependence on the starting temperature of the internal combustion engine. At starting temperatures below a predetermined temperature the interruption of the current circuit takes place with a time delay that corresponds to the warming of the electrically heated bimetal of the thermo-time switch. The known thermo-time switch of the electrical control circuit of the fuel supply device, however, has the disadvantage of a large spatial expansion, a relatively large consumption of current and an expensive production requirement.

OBJECT AND SUMMARY OF THE INVENTION

The electrical control circuit has the advantage that the cold conducting resistor has a small spatial expansion and can thus easily be arranged wherever necessary, even in relatively limited areas as well as having a low current consumption and is available as an inexpensive mass produced article. The arrangement of the cold conducting resistor in the electrical control circuit of a cold start device of fuel supply devices for internal combustion engines instead of the thermo-time switch that is provided in known devices is especially advantageous. Also advantageous is the arrangement of the cold conducting resistor on the electromagnetic valve of a cold start device of this type.

A further advantage of this invention is the fact that an electromagnetic system serves as the control member and that a valve means in a fluid conduit can be activated by said system.

Still another advantage of this invention is the fact that a cold conducting resistor (PTC resistor) is also included in the electrical circuit as a temperature-dependent element with said resistor being arranged either near an electromagnetic valve or in a coolant duct near one cylinder of the internal combustion engine.

The invention will be better understood as well as further objects and advantages thereof become more apparent from the ensuing detailed description of preferred embodiments taken in conjunction with the drawings.

DESCRIPTION OF THE PREFERRED EMBODIMENTS

Figure 1:
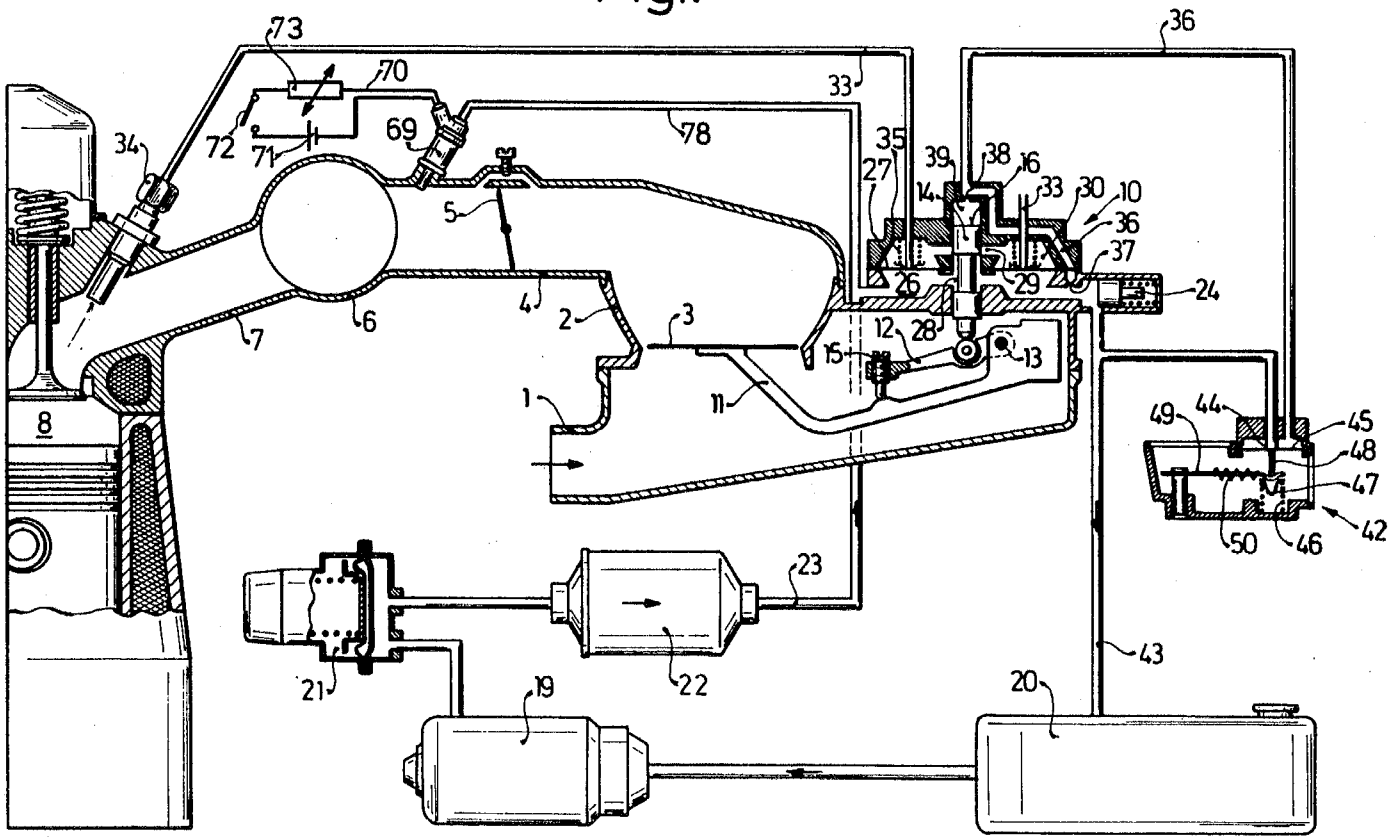
FIG. 1 shows a first exemplary embodiment of the arrangement of a cold conducting resistor in the electrical control circuit of a fuel supply device for internal combustion engines, which fuel supply device is provided with a cold start device.

Turning now to the drawings, in the fuel injection system illustrated in FIG. 1, the air for combustion flows in the direction of the arrow via a suction pipe section 1 in a conical passage 2 in which there is disposed an air flow sensor member 3 and also through a suction pipe section 4 having a throttle valve 5 controllable at will to a common intake manifold 6 and from there to one or more cylinders 8 of an internal combustion engine via a suction pipe section 7. The air flow sensor member 3 is a plate arranged transverse to the direction of flow, which moves within the conical passage 2 of the suction pipe approximately in accordance with a linear function of the amount of air flowing through the suction pipe, whereby for a constant restoring force applied to the air flow sensor member 3 and for a constant air pressure prevailing before the air flow sensor member 3, the pressure existing between the air flow sensor member 3 and the throttle valve 5 also remains constant. The air flow sensor member 3 controls a metering and distributing valve 10. The regulation movement of the air flow sensor member 3 is transmitted by a rocking lever 11 connected thereto which together with an adjustment lever 12 is mounted on a fulcrum point 13 and upon being pivoted actuates the movable valve component in the form of a control plunger 14 of the metering and distributing valve 10. The desired fuel-air mixture can be regulated by a mixture regulating screw 15. The front face of the control plunger 14 facing away from the rocking lever 11 is urged by pressure fluid, the force of which applied to the front face 16 constitutes the restoring force acting on the air flow sensor member 3.

The fuel is supplied by means of an electric fuel pump 19 which pumps the fuel out of a fuel tank 20 and supplies it to the metering and distributing valve 10 via a fuel accumulator 21, a fuel filter 22 and a fuel feeding conduit 23. A system pressure regulator 24 maintains the pressure of the system in the fuel injection system constant.

The fuel feeding conduit 23 opens via various branches into chambers 26 of the metering and distributing valve 10 so that one side of a diaphragm 27 will be affected by the fuel pressure. The chamber 26 also communicates with an annular T-slot 28 of the control plunger 24. Depending on the position of the control plunger 14, the annular T-slot 28 opens to a greater or lesser extent metering slits 29, each of which communicates with a respective chamber 30 that is separated from the chamber 26 by the diaphragm 27. From the chamber 30 fuel is supplied to the individual injection valves 34 by way of injection conduits 33, each injection valve being arranged in the suction pipe section 7 in the vicinity of the motor cylinder 8. The diaphragm 27 serves as a movable member of a flat seat valve which is retained in an open position by a spring when the fuel injection system is not in operation. The siphon diaphragms obtained in each chamber 26 and 30 act so that regardless of the overhead existing between the annular T-slot 28 and the metering slits 29 and of the amount of fuel flowing toward the injection valves 34 the pressure gradient at the metering valves 28, 29 remains substantially constant. In this manner, there is ensured that the adjusting path of the control plunger 14 and the amount of fuel to be measured are proportional.

When the rocking lever 11 is pivoted, the air flow sensor member 3 positioned in the conical passage 2 is inclined so that the altering transverse section between the air flow sensor member and the cone is substantially proportional to the regulation movement of the air flow sensor member 3.

The pressure fluid producing the restoring force acting on the control plunger 14 is the fuel. Thus, a control pressure conduit 36 branches off the fuel feed conduit 23 and is separated from the fuel feed conduit 23 by means of an offtake choke bore 37. The control pressure conduit 36 communicates with a pressure space 39 via a damping choke bore or port 38, the control plunger 14 having its front face 16 arranged to extend into the space 39.

A pressure regulating valve 42 is arranged in the control pressure conduit 36 and through it pressure fluid can return to the fuel tank through a pipe 43. The force of the pressure fluid generating the restoring force during the heating-up phase of the internal combustion engine can be regulated in accordance with a temperature/time function by means of pressure regulating valve 42.

The pressure regulating valve 42 in this invention is in the form of a flat seat valve having a fixed valve seat 44 and a diaphragm 45 which serves as a movable valve component, the diaphragm 45 being urged in the direction of closure of the valve by a pressure spring 46. The spring 46 acts on the diaphragm 45 by means of a spring cap 47 and a transmission stud 48. At temperatures below the operational temperature of the engine the force of the spring 46 overcomes the force of a bimetallic spring 49.

In order to insure a reliable start of the internal combustion engine at starting temperatures beneath about 30° C., an electromagnetic valve 69 is provided, which serves to lead additional fuel into the common intake manifold 6 during the starting process. The electromagnetic valve 69 is arranged in an electrical control circuit 70 as a control member that reacts to the electrical current. The control circuit 70 lies inside the vehicle battery 71, and is closed by the starting switch 72 during the starting process. A cold conducting resistor (PTC resistor) 73 is also included in the electrical control circuit 70 as a temperature-dependent element. This cold conducting resistor 73 can be arranged at any desirable location in the internal combustion engine, for example (when provided with a protective covering) in a coolant duct near one of the cylinders 8 of the internal combustion engine, in order to determine the starting temperature of the internal combustion engine. It can also be useful to arrange the cold conducting resistor 73 directly near the electromagnetic valve 69.

Figure 3:
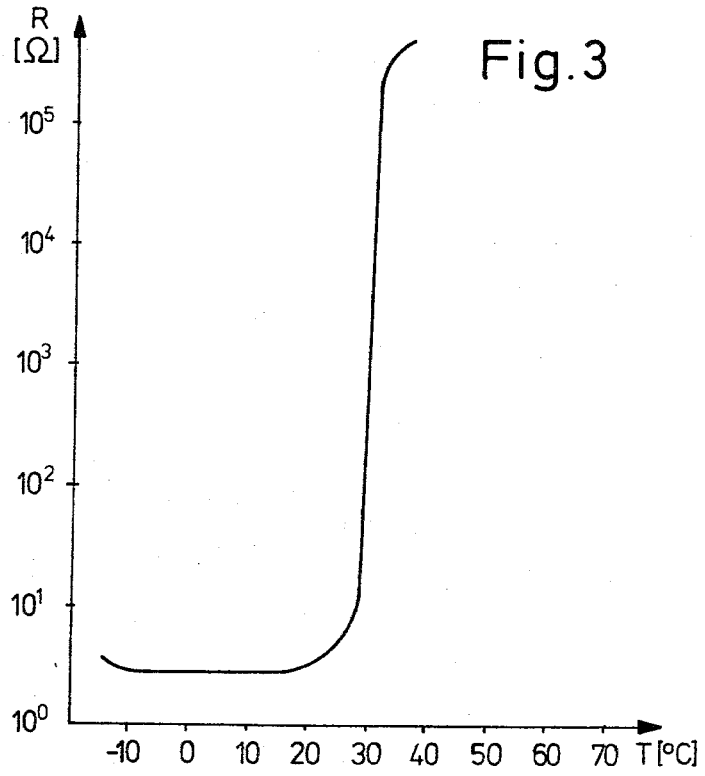
FIG. 3 shows diagrammatically the temperature-dependent curve of the resistor of a cold conducting resistor.

In FIG. 3 the curve of the resistance R (ohms) of the cold conducting resistor 73 is shown as being dependent on the temperature T (degrees Celsius). It is thus shown that for a given cold conducting resistor the resistance R is very low at temperatures below approximately 30° C., but at temperatures immediately above approximately 30° C. the resistance R climbs to a much higher value. Thus, if the starting switch is closed at temperatures below approximately 30° C., a current flows through the cold conducting resistor 73 and the coils of the electromagnetic valve 69. This current effects the opening of the electromagnetic valve 69 and also heats up the cold conducting resistor 73. Once the cold conducting resistor 73 has been heated to its switch temperature of approximately 30° C., the resistance R of the cold conducting resistor 73 immediately jumps to a much higher value, causing the current flow to drop off and the electromagnetic valve 69 to close. A time-dependent fuel enrichment is thus obtained during a cold start of an internal combustion engine below approximately 30° C. If the starting process takes place at temperatures above approximately 30° C., the resistance R of the cold conducting resistor 73 is very high and the flowing current is no longer sufficient to open the electromagnetic valve 69. Thus, at temperatures above this switch temperature of 30° C. there is no fuel enrichment during the starting process of the internal combustion engine. Cold conducting resistors are available for this type of control functions for any switch temperatures with a sudden jump in the resistance at temperatures from roughly −40° C. to roughly +120° C.

Figure 2:
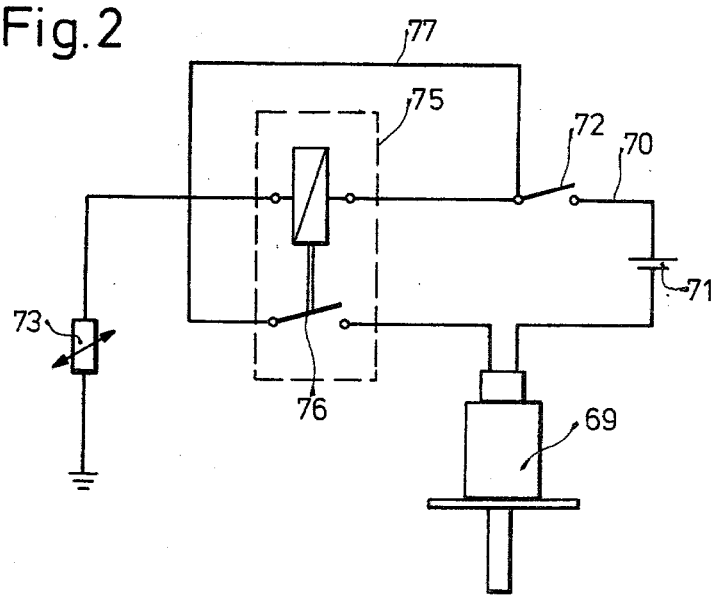
FIG. 2 shows a second exemplary embodiment of the arrangement of a cold conducting resistor.

In the second exemplary embodiment of the invention according to FIG. 2, a relay 75 is arranged in the electrical control circuit 70 adjacent to the vehicle battery 71 instead of the electromagnetic valve 69. This relay 75 controls the current circuit 77 of the electromagnetic valve 69 that lies adjacent to the vehicle battery 71 by means of the starting switch 72, and accomplishes said control by means of a switch 76. A cold conducting resistor 73 is also arranged in the electrical control circuit 70, which has a very low resistance R at temperatures below a predetermined switch temperature, so that when the starting switch 72 is closed the relay 75 is activated and the switch 76 closes, thus the electromagnetic valve 69 is also activated and opens. Once the cold conducting resistor 73 has heated to the switch temperature, the resistance of the cold conductor immediately jumps and the current decreases to such an extent that the relay 75 is eliminated and the switch 76 opens, so that the electromagnetic valve 69 is no longer activated and closes. If the starting switch 72 of the electrical control circuit 70 is closed at temperatures above the switch temperature of the cold conducting resistor 73, then the relay 75 does not respond because of insufficient current and the electromagnetic valve 69 remains closed. The fuel supply of the electromagnetic valve 69 takes place by means of a conduit 78, which is connected with the fuel supply line 23.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. In an internal combustion engine of the fuel injected type having an intake manifold, a battery, an engine starting switch and a fuel supply system having a high pressure side, an auxiliary fuel supply system for startup at temperatures below a predetermined minimum comprising:

a normally closed electromagnetic valve connecting the intake manifold with said high pressure side of the fuel supply system of said engine; and a control circuit including a PTC resistor connected in series with said valve and the battery and starting switch of the engine, said resistor being of very low resistance below said predetermined minimum temperature and having a resistance temperature characteristic which rises substantially above said minimum temperature, whereby said valve is opened when the starting switch is closed below said minimum temperature but remains closed when the temperature is only slightly above said predetermined temperature, said control circuit having a current flow which flows through said PTC resistor when said starting switch is closed which heats said PTC resistor for a specific duration in accordance with the characteristics of said PTC resistor until said predetermined temperature is attained whereby said specific duration determines the period of time for the metering of the supplementary fuel quantity to said engine.

2. The combination defined by claim 1 in which said PTC resistor is about 5 ohms from about −20° C. to about +20° C. and is about $10^5$ ohms at about 30° C.

3. A fuel supply system for an internal combustion engine comprising, in combination, a normally closed electromagnetic valve for metering a supplementary quantity of fuel to said engine, a first control circuit comprising the series connection of a battery, an engine starting switch, a relay having a normally open switch and a PTC resistor, a second control circuit comprising the series connection of said electromagnetic valve, said normally open switch, said starting switch and said battery, said PTC resistor having a low resistance below a predetermined minimum temperature to permit the flow of current in said first control circuit when said starting switch is closed for energizing said relay and closing said relay switch to permit the flow of current in said second control circuit for opening said electromagnetic valve to meter said supplementary fuel quantity, said current flow in said first control circuit producing a heating-up of said PTC resistor to said predetermined temperature within a period of time determined by the characteristics of said PTC resistor whereby the resistance of said PTC resistor rises substantially at said predetermined temperature to interrupt the flow of current in said first control circuit for deenergizing said relay and interrupting said second control circuit terminating the metering of said supplementary fuel quantity.

4. The combination defined by claim 3 in which said PTC resistor is about 5 ohms from about −20° C. to about +20° C. and is about $10^5$ ohms at about 30° C.

* * * * *